US005625970A

United States Patent [19]

Pantuso et al.

[11] Patent Number: 5,625,970

[45] Date of Patent: May 6, 1997

[54] FIREARM SAFETY MECHANISM WITH IMPROVED TRIGGER PULL

[75] Inventors: Corey N. Pantuso, Freedom; Donn L. Dunnigan, Thayne, both of Wyo.

[73] Assignee: Freedom Arms, Inc., Freedom, Wyo.

[21] Appl. No.: 728,313

[22] Filed: Oct. 8, 1996

Related U.S. Application Data

[62] Division of Ser. No. 496,629, Jun. 29, 1995.

[51] Int. Cl.[6] ..... F41A 17/74

[52] U.S. Cl. ..... 42/66

[58] Field of Search ..... 42/66, 67, 65

[56] References Cited

U.S. PATENT DOCUMENTS

| | | | |
|---|---|---|---|
| 158,957 | 1/1875 | Mason | 42/59 |
| 3,157,958 | 11/1964 | Lewis | 42/66 |
| 3,701,213 | 10/1972 | Lewis . | |
| 3,768,190 | 10/1973 | Ruger et al. | 42/66 |
| 3,777,384 | 12/1973 | Ruger et al. | 42/66 |
| 3,810,326 | 5/1974 | Hillberg et al. . | |
| 3,824,728 | 7/1974 | Kennedy . | |
| 3,962,809 | 6/1976 | Lee . | |
| 3,988,848 | 11/1976 | Chatigny . | |
| 4,218,839 | 8/1980 | Brouthers | 42/65 |
| 4,228,608 | 10/1980 | Casull | 42/67 |
| 4,316,340 | 2/1982 | Kahn | 42/66 |
| 4,316,341 | 2/1982 | Landry . | |
| 4,383,383 | 5/1983 | Landry | 42/67 |
| 4,391,057 | 7/1983 | Bornancini | 42/65 |
| 4,437,250 | 3/1984 | Beretta | 42/65 |
| 4,449,312 | 5/1984 | Ruger et al. | 42/66 |
| 4,680,884 | 7/1987 | Smith, Jr. et al. | 42/66 |
| 4,807,380 | 2/1989 | Domian | 42/65 |
| 4,962,606 | 10/1990 | Pozzi . | |

*Primary Examiner*—Michael J. Carone
*Assistant Examiner*—Theresa M. Wesson
*Attorney, Agent, or Firm*—Workman, Nydegger & Seeley

[57] ABSTRACT

A safety mechanism for use with a firearm having a hammer wherein the hammer has an elongated, vertically extending recess formed therein, a transfer bar traveling within that elongated recess between an extended position and a retracted position. When the transfer bar is in the extended position, the bar is interposed between the hammer and the firing pin allowing discharge of a cartridge within the chamber. When the transfer bar is in the retracted position, a portion of the recess is exposed. The exposed recess is larger than the portion of the firing pin which protrudes from the receiver. Thus, inadvertent firing is prevented as the hammer cannot contact the firing pin. A transfer bar carrier pin located on the hand assembly initially cooperates with the trigger cam and the transfer bar to elevate the bar into the extended position. The weight of the safety mechanism is, therefore, not borne by the trigger, when the hammer is in the full cock position, resulting in a lighter and more accurate trigger pull. After the trigger has been fully actuated, the transfer bar carrier drops with the hand mechanism and a cam on the trigger maintains the transfer bar in the extended position. The trigger must remain in the fully actuated position until the hammer and transfer bar impact the firing pin. Premature release of the trigger will allow the transfer bar to drop and the firing pin will merely enter the recess in the hammer without contacting the hammer.

1 Claim, 6 Drawing Sheets

FIREARM SAFETY MECHANISM WITH IMPROVED TRIGGER PULL

This application is a divisional of application Ser. No. 08/496,629, filed Jun. 29, 1995.

BACKGROUND

1. Field of the Invention

The present invention relates to safety mechanisms employed in firearms utilizing a hammer and a firing pin, and in particular to improved safety mechanisms for such firearms providing for improved trigger pull characteristics.

2. Background Art

In an effort to improve upon the safety of firearms, devices have been introduced which require the presence of a safety bar between the hammer and the firing pin to transfer the kinetic energy from the hammer to the firing pin. For example, in U.S. Pat. No. No. 566,393 to Fyrberg, the rearward motion of the trigger causes the release of the hammer which moves a pawl upward so as to bring the end of the pawl in the path of the hammer between the hammer face and the firing pin. These safety devices are typically in a retracted position until the hammer is fully cocked. If the device is not extended, the face of the hammer presents a space into which the head of the firing pin is received without effecting contact with the firing pin. When the safety device is in an extended position, the hammer face strikes the safety bar and impact is carried through to the firing pin causing the cartridge to discharge. This safety device is often called a trigger bar because the bar is mechanically elevated and is maintained in that elevated position through physical attachment to the trigger.

As a result, the weight of the trigger bar or analogous safety method must be overcome by rearward pressure on the trigger. This increased pressure on the trigger results in a reduction in accuracy. This is especially felt in light-weight firearms such as hand guns and firearms used in competition. After actuation of the trigger, the device is then maintained in the elevated position by a continued rearward pressure on the trigger as the hammer strikes the firing pin.

Release of the trigger allows the device to retract and the firing pin then extends into a recess in the hammer. This recess protects the firing pin from inadvertent impact when carrying the firearm.

BRIEF SUMMARY AND OBJECTS OF THE INVENTION

It is therefore an object of the present invention to provide a firearm safety mechanism capable of interposition between the hammer and the firing pin to allow discharge of the cartridge within the chamber when the trigger is pulled, the safety mechanism also being capable of being juxtaposed with the firing pin when the trigger is not pulled to prevent discharge.

It is another object of the present invention to provide a safety mechanism for a firearm wherein the weight of the safety mechanism is not carried by, nor attached to, the trigger.

Additional objects and advantages of the invention will be set forth in the description which follows, and in part will be obvious from the description, or may be learned by the practice of the invention. The objects and advantages of the invention may be realized and obtained by means of the instruments and combinations particularly pointed out in the appended claims.

To achieve the foregoing objects, and in accordance with the invention as embodied and broadly described herein a firearm safety mechanism with improved trigger pull is provided wherein the weight of the safety mechanism is not on the trigger when the hammer is in the "full cock" position. In prior art safety mechanisms, an elongated trigger bar is interposed between the external hammer of the firearm and the firing pin. One end of the trigger bar is attached to the trigger. As the hammer is drawn back, the trigger maintains upward pressure on the trigger bar thereby maintaining the bar in an elevated position relative to the hammer face. When the trigger is pulled, the trigger maintains the trigger bar in the elevated position thereby allowing contact between the hammer and the firing pin to discharge the cartridge in the chamber. Any inadvertent releasing of the hammer without rearward pressure on the trigger results in a loss of contact between the trigger bar and the firing pin. As a result, the hammer phase does not strike the firing pin and the cartridge is not discharged.

The advancement presented in the present invention serves to separate the trigger from the trigger bar during the period when the trigger is pulled. As a result, the weight of the safety mechanism is not home by the trigger while the hammer is fully cocked. This is accomplished by providing means for positioning the transfer bar into the extended position free from contact with the trigger. As the hammer is cocked, the weight of the transfer bar is borne by the means for positioning. When the trigger is fully actuated, and the hammer is moving forward, the means for positioning drops away. If the trigger is maintained in the fully actuated position, the support of the transfer bar is shifted from the means for positioning to the trigger. Thus, the trigger must be actuated and must be maintained in the fully actuated position for the firearm to discharge.

BRIEF DESCRIPTION OF THE DRAWINGS

In order to completely understand the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are therefore not to be considered limiting of its scope, the invention will be described with additional specificity and detail through the use of the accompanying drawings in which.

DETAILED DESCRIPTION OF THE PREFERRED EMBODIMENTS

Reference is now made to FIGS. 1 through 4 in which a firearm action is illustrated in cross-sectional detail. Although the present invention can be utilized with any firearm having a hammer, for ease of explanation, a single action revolver is depicted in FIGS. 1 through 4. Similarly, the instant invention can not only be used in new guns, but may also be retrofit into existing actions by modifying or replacing only a few components.

Figure 1:
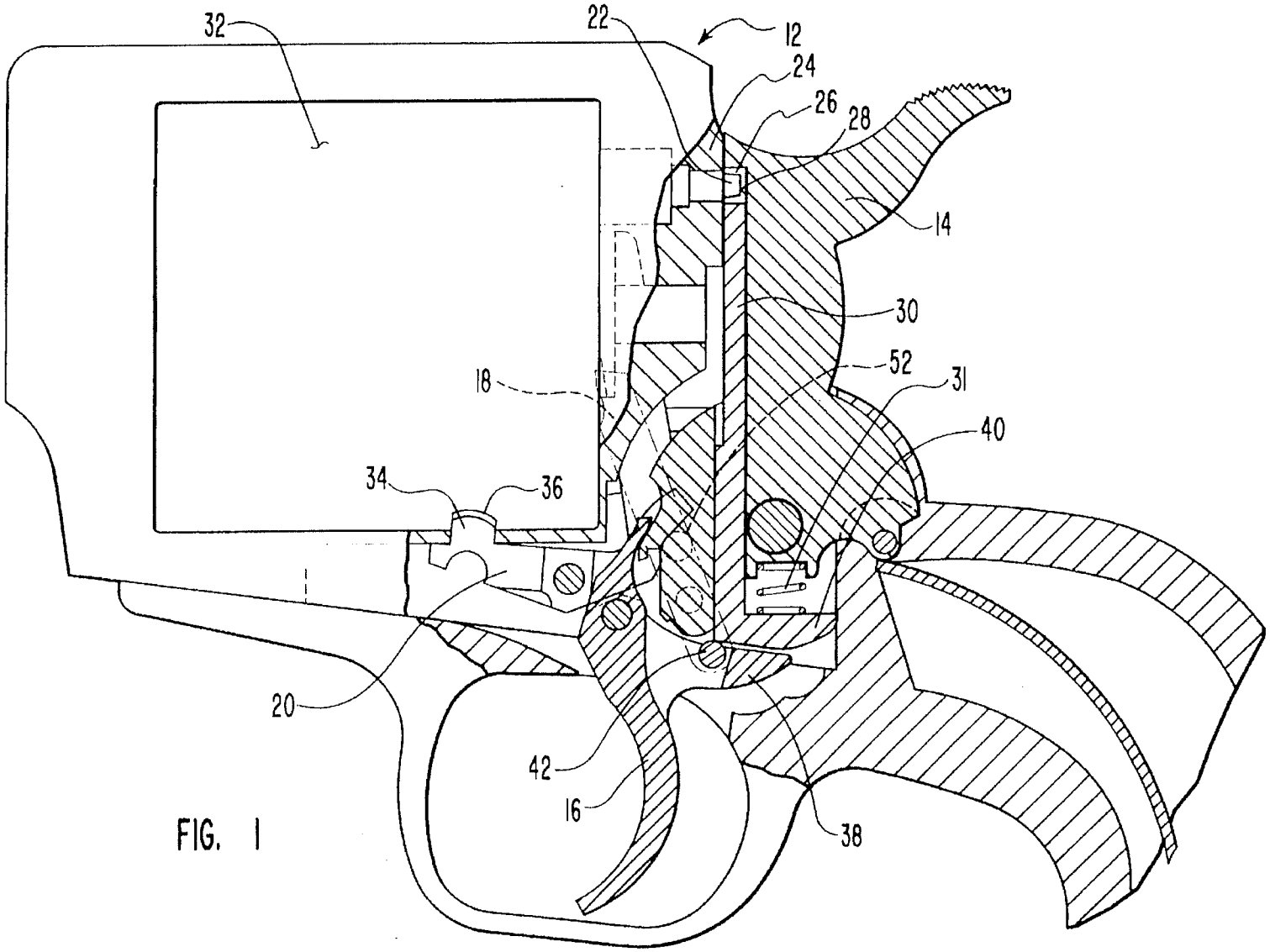
FIG. 1 is a cross-sectional elevational view of a firearm embodying the instant invention showing the action in the "hammer-down, safe" position.

Referring now to FIG. 1, an action shown generally as 12 is depicted having a hammer 14, a trigger 16, a hand 18, and a cylinder lock 20. The action in FIG. 1 is in a "hammer down, safe" position which is typically utilized when carrying the firearm. This is called the safe position because hammer 14 is resting against the back of receiver 24 and is therefore incapable of forward movement. An elongated vertically extending recess 26 is formed within a face 28 of hammer 14. Firing pin 22 is shown disposed within that recess. As firing pin 22 is within recess and is not in contact with hammer 14, firing pin 22 is protected from inadvertent impact. Also located within recess 26 is a transfer bar 30. Transfer bar 30 slides within recess 26 between an extended position and a retracted position. Transfer bar 30 is shown juxtaposed to firing pin 22 in the retracted position in FIG. 1. When transfer bar 30 is in the retracted position, firing pin 22 cannot be impacted by hammer 14. Also, if the trigger is pulled, the transfer bar cannot move to the extended position due to interference with the firing pin.

In order for a cartridge in a chamber of the firearm to be discharged, the kinetic energy from the release of hammer 14 must be transferred through transfer bar 30 to firing pin 22. An inadvertent release of hammer 14 when transfer bar 30 is in the retracted position results in the hammer 14 impacting receiver 24 and not firing pin 22. Firing pin 22 will be prevented from being impacted by hammer 14 as the firing pin will be protected in recess 26 and transfer bar 30 will be in the retracted position.

A cylinder 32 is shown locked into position by a lug 34 located on cylinder lock 20. Lug 34 is biased into position in one of several notches 36 to lock the cylinder into position. Activated by trigger 16 is a cam 38. In the depicted embodiment, the cam 38 is formed integral with the trigger, however, the only structural limitation imposed is that the trigger must activate the cam 38. Cam 38 is not in contact with a transfer bar cam 40 located at the bottom of transfer bar 30. Instead, transfer bar cam 40 is supported by a means for positioning the transfer bar into the extended position and the retracted position. In an embodiment illustrated in FIG. 1, the means for positioning the transfer bar is a transfer bar carrier pin 42. Carrier pin 42 maintains the weight of the transfer bar when the trigger is being actuated.

Figure 2:
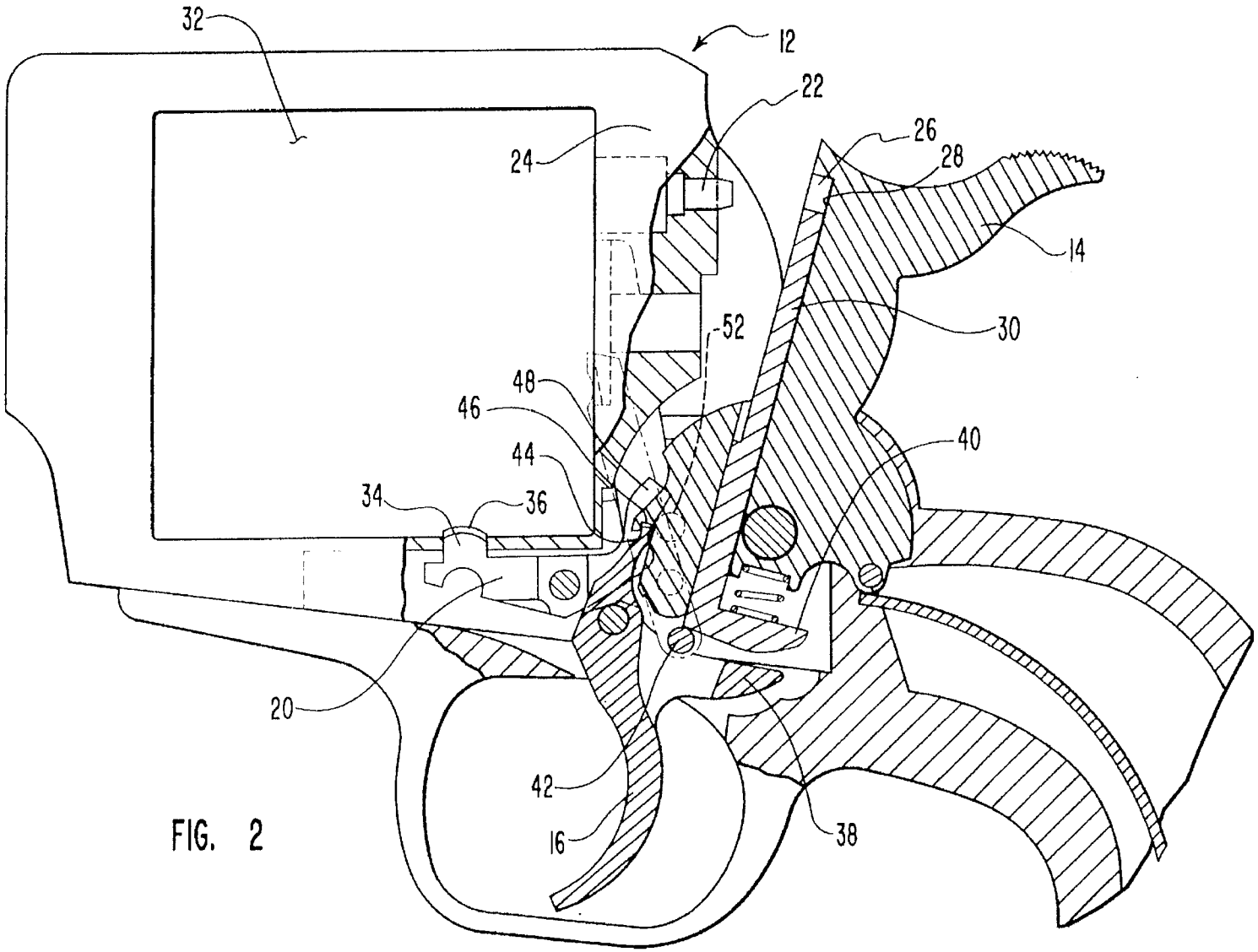
FIG. 2 is an action like that shown in FIG. 1 demonstrating the relative position of the components of the action in the "half-cock, loading" position.
Figure 6C:
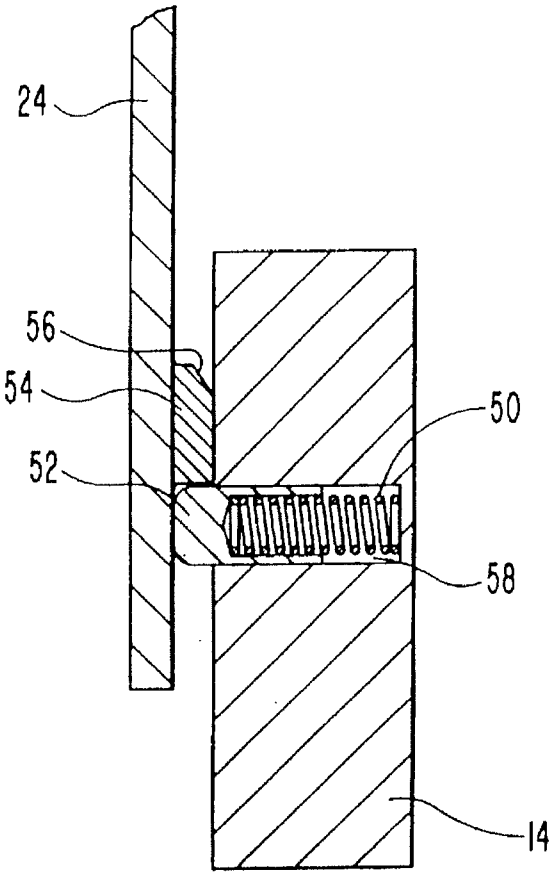
FIGS. 6A–6C are cross-sectional views of the plunger in various positions throughout the movement of the action depicted in FIGS. 1–5.

FIG. 2 illustrates the firearm action of FIG. 1, wherein the action is in a half-cock, loading position. In the half-cock position, the hammer 14 has been rotated away from receiver 24 to a point where a trigger sear 44 engages a sear half-cock notch 46 in hammer 14. When trigger sear 44 is engaged in sear half-cock notch 46, the trigger may not be actuated and the hammer is prevented from any forward movement. Movement of hammer 14 rotationally clockwise (FIG. 2) achieves engagement of trigger sear 44 in sear half-cock notch 46 resulting in the action being in the half-cock position. Rotation of hammer 14 also rotates plunger 52 which is partially recessed into hammer 14. (See FIGS. 6A–6C.) The position of plunger 52 under cylinder lock 20 results in the lifting of an end 54 of cylinder lock 20 when hammer 14 is rotated. The lifting of end 54 pivots lug 34 out of notch 36 to allow cylinder 32 to freely rotate. It is in this position that the embodiment illustrated in FIG. 2 is easiest to load.

It should be clear that not all embodiments will have a half-cock or loading position on the hammer into which the trigger sear may be engaged. This position is merely utilized to demonstrate the movement of the transfer bar relative to the trigger. In this position, transfer bar 30 is upheld by carrier pin 42 and is not in contact with trigger 16. As the hammer 14 is rotated rearwardly between the safe position and the half-cock position, transfer bar cam 40 may momentarily contact trigger cam 38. It is important to note that although such contact may occur in some embodiments, one aspect of the invention is that such contact does not occur in the full-cock position, and that such contact does not occur until after the trigger has been fully actuated.

Although plunger 52 is shown elevating end 54 of cylinder lock 20, it should be appreciated that other structures may be used to elevate end 54 in conjunction with the rotation of hammer 14. The only structural limitation imposed on the elevator is that it must be able to be recessed into hammer 14 so that upon activation of the trigger, the forward rotation of the hammer will not be impeded. This can be accomplished by spring-loading the plunger so that the plunger will retract into the hammer upon impact against end 54. Plunger 52 is biasing outwardly out of hammer 14, but retracts to pass by rearward portion 48 and end 54 after trigger 16 has been actuated and hammer 14 is rotated in a forward direction. Although not illustrated, it is well known in the art that hammer 14 can be biased using several techniques, the most common of which is a spring located within the grip frame. Similarly, a biasing means such as a spring 31 is utilized to bias transfer bar 30 in a downward direction. The bias supplied to transfer bar 30 must be sufficient to place transfer bar 30 in the retracted position before an inadvertent release of hammer 14 allows contact with firing pin 22.

Figure 3:
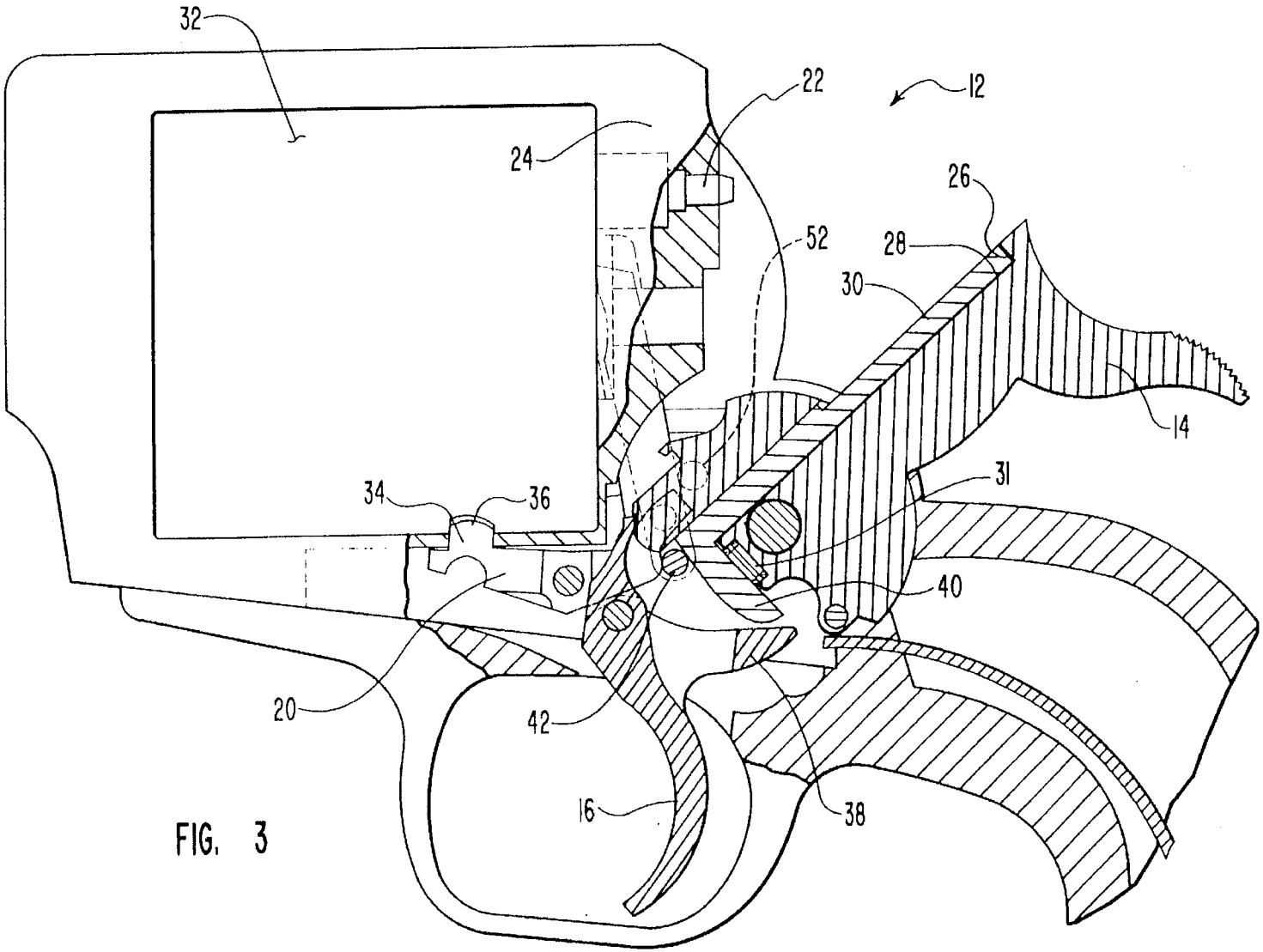
FIG. 3 is a cross-sectional elevational view of the action like that shown in FIGS. 1 and 2 demonstrating the relative position of the components in the "full-cock, ready to fire," position.

FIG. 3 depicts the action illustrated in FIGS. 1 and 2 in the "full-cock" or "ready-to-fire" position. In this position, cam 38 of trigger 16 is not in contact with transfer bar 30. Transfer bar 30 is in the extended position filling recess 26 and is interposed between firing pin 22 and hammer face 28. Transfer bar 30 is raised to and held in the extended position by the means for positioning. In this embodiment, the means for positioning is carrier pin 42 which is attached to hand 18. Rotation of the hammer to the full-cock position results in the movement of hand 18 and concomitant upward movement of carrier pin 42 and transfer bar 30 to the extended position. Inadvertent release of hammer 14 at this point would result in transfer bar 30 being biased out of the extended position at a point in the travel of hammer 14 between the full-cock and the hammer down positions.

No discharge would occur. Instead, hand 18 which is attached to hammer 14 would be lowered thereby lowering carrier pin 42. The lowering of carrier pin 42 into its retracted position would normally allow transfer bar 30 to drop thereby opening the portion of recess 26 allowing contact of hammer 14 with the rear of cylinder housing 24 without transferring kinetic energy to firing pin 22.

During intentional firing of the firearm, however full actuation of trigger 16 results in the pivoting of cam 38 into contact with transfer bar cam 40 and continued pressure on trigger 16 retains transfer bar 30 in the extended position despite the lowering of hand 18 and carrier pin 42. By maintaining transfer bar 30 in the extended position, the kinetic energy created by the release of hammer 14 is transferred through transfer bar 30 into firing pin 22 thereby discharging the cartridge.

The advantage to this aspect of the invention is that the trigger may be actuated without the weight of transfer bar 30 being placed on cam 38. The weight of transfer bar 30 is not borne by cam 38 until after trigger 16 has actuated the release of hammer 14. This results in a much lighter and smoother pull and thereby imparts more accuracy to the firearm.

Plunger 52 may be seen in phantom at a position above end 54. Rotation of hammer 14 to the full-cock position concomitantly rotates plunger 52 around end 54, thereby releasing end 54 and allowing lug 34 to be biased back into notch 36.

Figure 4:
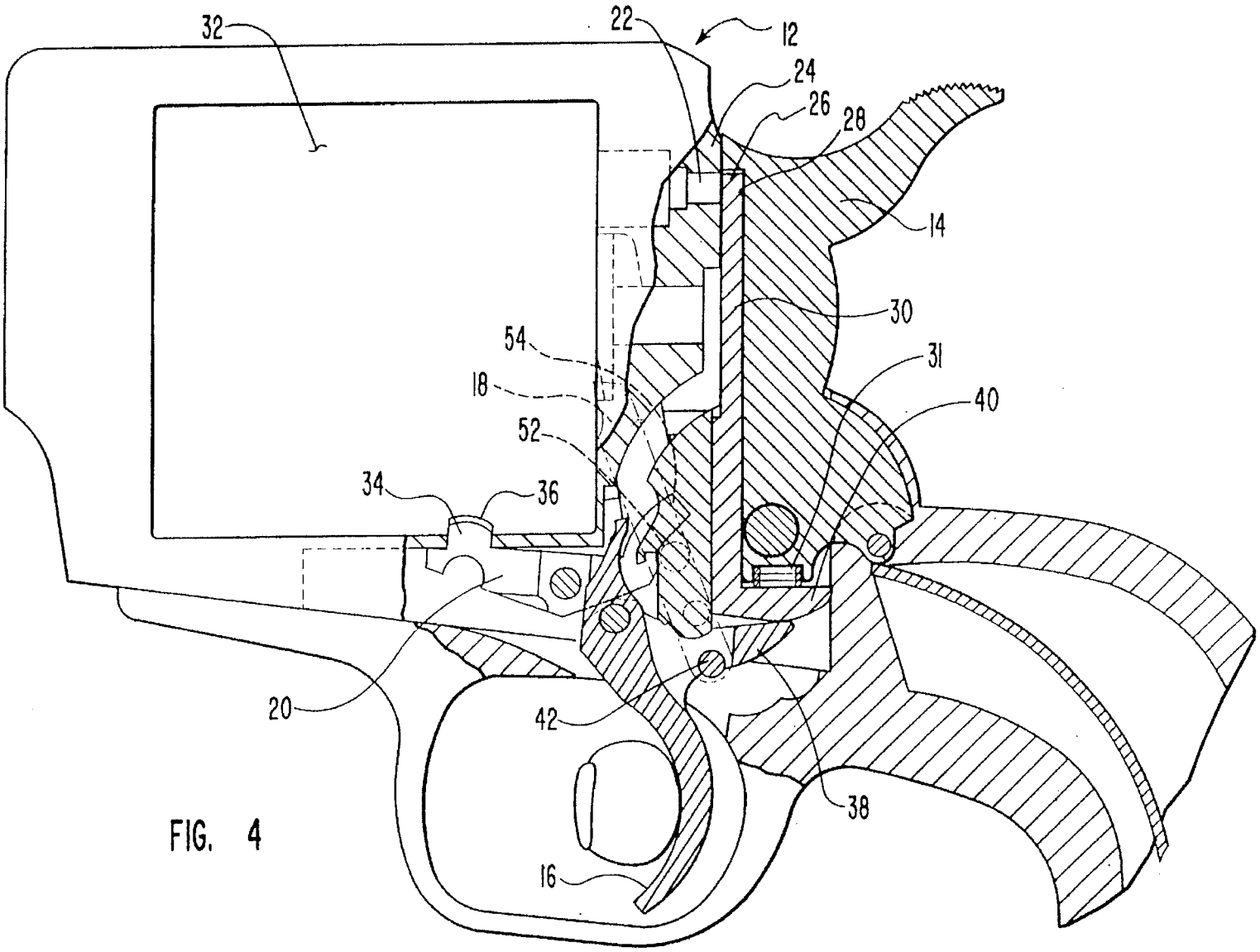
FIG. 4 is an action shown like that in FIGS. 1 through 3 demonstrating the relative position of the components in the "hammer down, fired" position.

FIG. 4 depicts the action in FIGS. 1 through 3 after the trigger has been fully actuated, but before the trigger has been released. As previously discussed, if trigger 16 is released before hammer 14 and transfer bar 30 contact firing pin 22, then transfer bar 30 will be biased into the retracted position and recess 26 will be exposed into which firing pin 22 will enter. Since recess 26 is dimensioned larger than the portion of firing pin 22 which extends beyond receiver 24, no contact is made between hammer 14 and firing pin 22 when transfer bar 30 is in a retracted position. When trigger 16 is maintained in the actuated position, however, cam 38 maintains transfer bar 30 in the extended position and the kinetic energy from hammer 14 is transferred through transfer bar 30 into firing pin 22 and the cartridge within the chamber is discharged. Upon release of the trigger, transfer bar 30 will be biased downward to once again rest on the means for positioning. The firing pin 22 will be biased outward into recess 26 and the action will be ready to be cycled once again.

Plunger 52 is shown below end 54. Upon release of hammer 14, plunger 52 is rotated forward and downward until plunger 52 impacts end 54. Plunger 52 is then forced into a recess in hammer 14 until hammer 14 has rotated near the hammer down position. Plunger 52 is then rotated past the bottom of end 54 and is biased outward once again.

Figure 5:
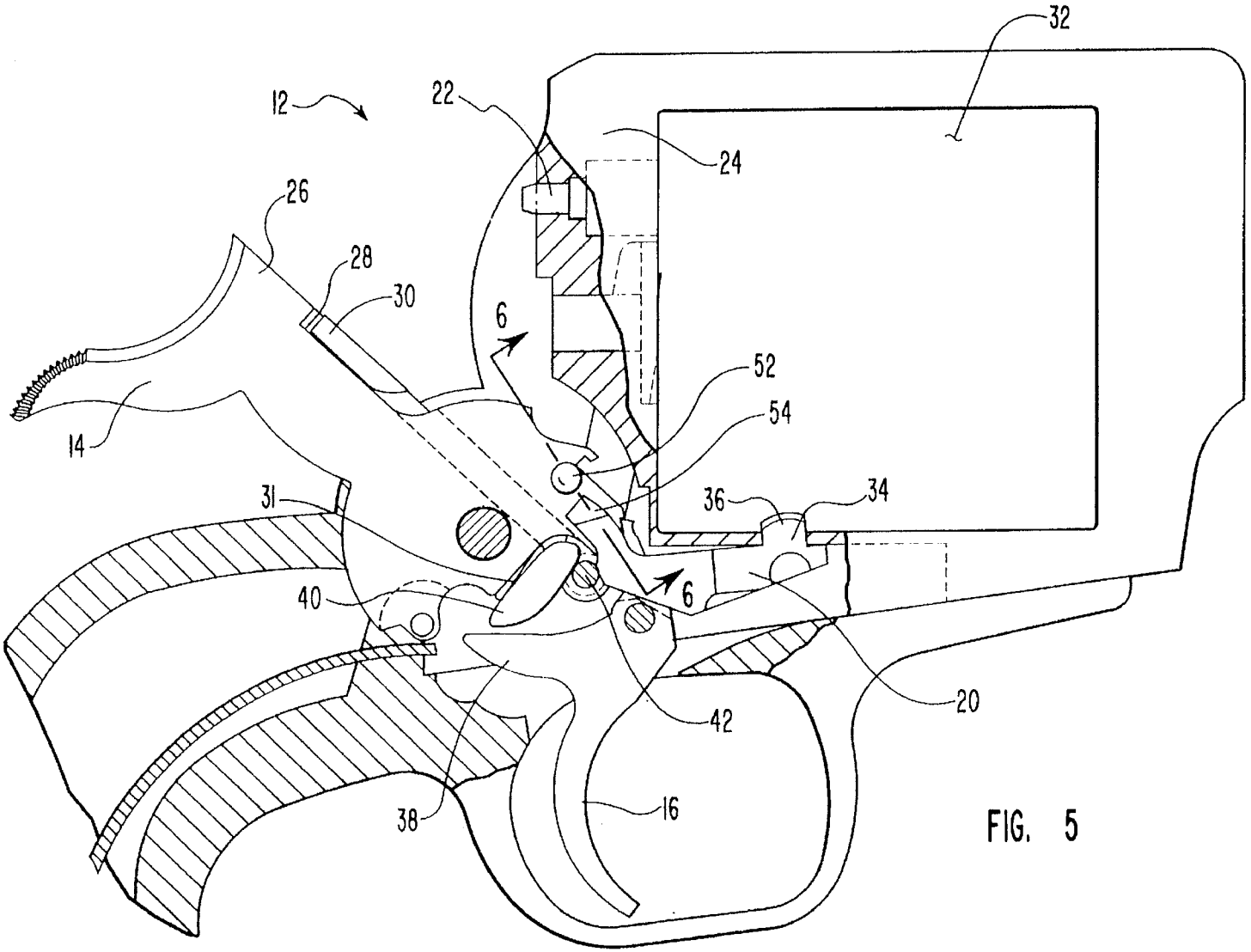
FIG. 5 is a partially cut-away elevational view of the other side of the action depicted in FIG. 4.
Figure 6B:
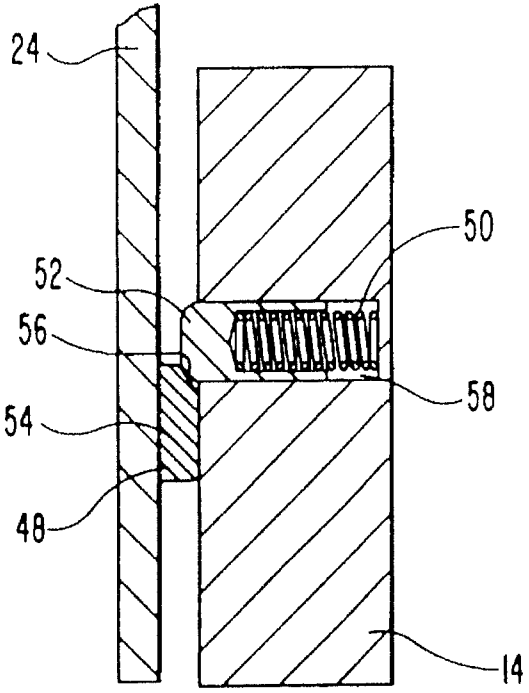
Figure 6A:
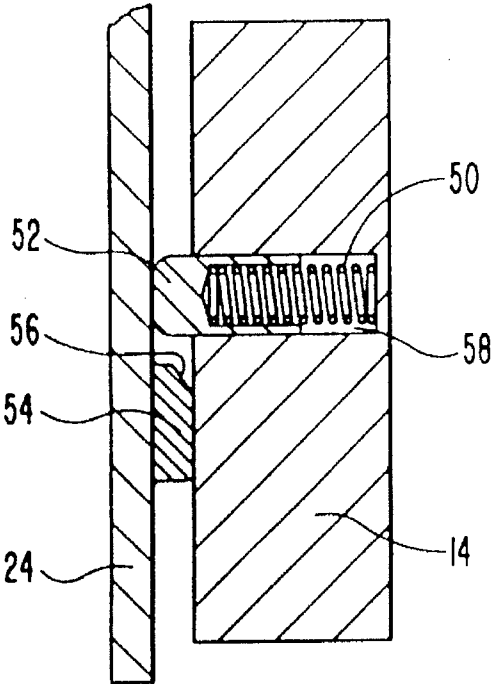

To more fully understand the interaction of plunger 52 with end 54, reference should now be made to FIGS. 5 and 6A–6C. In FIG. 5, the location of plunger 52 in the full-cock position is illustrated. The relationship between plunger 52 and end 54 in the full-cock position is demonstrated in FIG. 6A. The plunger is biased outwardly by a spring 50 to a position above end 54. Upon actuation of the trigger, hammer 14 will rotate forward (clockwise in FIG. 5) thereby bringing plunger 52 into contact with end 54. Plunger 52 will first encounter a ramped portion 56 which will cause plunger 52 to be compressed against spring 50 into a recess 58. This relationship is illustrated in FIG. 6B.

Further rotation of hammer 14 will result in the full compression of spring 50 and the complete recession of plunger 52 into recess 58. This will allow the plunger to pass by end 54.

Upon passage by end 54, spring 50 will again bias plunger 52 out of recess 58 and plunger 52 will extend once again to a position where end 54 may be engaged.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Patent is:

1. A safety mechanism for use with a firearm having a hammer, a cartridge receiving chamber in front of the hammer, a firing pin interposed between a face of the hammer and the cartridge receiving chamber so as to strike and fire a cartridge in the chamber upon actuation by a trigger, the safety mechanism comprising:

a) an elongated recess formed within the face of the hammer;

b) an elongated transfer bar disposed within said recess and slidably movable therein between an extended position and a retracted position, the transfer bar being interposed between the hammer and the firing pin in the extended position, and the transfer bar being juxtaposed to the firing pin in the retracted position thereby exposing a portion of the recess capable of receiving the firing pin therein, thereby preventing contact with the hammer;

c) means independent of the trigger for positioning the transfer bar into the extended position and the retracted position;

d) a trigger cam operated upon by the trigger, the trigger cam being capable of supporting the transfer bar to maintain the transfer bar in the extended position after the trigger has been actuated;

e) a cylinder locking means having a lug which is biased into a notch in the cylinder to prevent rotation of the cylinder within the receiver; and f) a plunger housed within a recess in the hammer, the plunger capable of pivoting the cylinder locking means out of engagement with the notch in the cylinder to thereby allow rotation of the cylinder, the plunger also being capable of retracting within the recess to pass by the cylinder locking means as the hammer is rotated forward.

* * * * *

UNITED STATES PATENT AND TRADEMARK OFFICE

CERTIFICATE OF CORRECTION

PATENT NO. : 5,625,970

DATED : May 6, 1997

INVENTOR(S) : Corey N. Pantuso; Donn L. Dunnigan

It is certified that error appears in the above-identified patent and that said Letters Patent is hereby corrected as shown below:

Col. 2, line 24, "home" should be --borne--

Signed and Sealed this

Thirty-first Day of March, 1998

*Attest:*

*Attesting Officer*

BRUCE LEHMAN

*Commissioner of Patents and Trademarks*